US008215978B1

(12) United States Patent
Sun et al.

(10) Patent No.: US 8,215,978 B1
(45) Date of Patent: Jul. 10, 2012

(54) CONNECTOR RETAINING DEVICE

(75) Inventors: Zheng-Heng Sun, New Taipei (TW); Li-Ren Fu, Shenzhen (CN); Jun-Hui Wang, Shenzhen (CN); Al-Ling He, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/172,877

(22) Filed: Jun. 30, 2011

(30) Foreign Application Priority Data

May 3, 2011 (CN) ..... 2011 2 0135602 U

(51) Int. Cl.
*H01R 13/62* (2006.01)

(52) U.S. Cl. ..... 439/369

(58) Field of Classification Search ..... 439/369, 439/367

See application file for complete search history.

(56) References Cited

U.S. PATENT DOCUMENTS 7,384,297 B2 * 6/2008 King et al. ..... 439/369
7,553,181 B1 * 6/2009 Van Dalinda, III ..... 439/369

* cited by examiner

*Primary Examiner* — Phuong Dinh
(74) *Attorney, Agent, or Firm* — Altis Law Group, Inc.

(57) ABSTRACT

A connector retaining device for retaining interconnection between two connectors includes an upper frame and a lower frame. The upper frame includes two parallel side members and two parallel end members connected between opposite ends of the side members. Each side member includes a cutout defined in an upper edge thereof and a hook extending downwardly beyond a lower edge thereof, each end member defines a recess in a lower edge thereof. The a lower frame includes two parallel side members and two parallel end members connected between opposite ends of the side members. Each side member included a cutout defined in a lower edge thereof and a hook extending upward beyond an upper edge thereof, each end member defines a recess in an upper edge thereof. The upper frame is attachable to the lower frame for sandwiching the combined connectors therebetween and surrounding the combined connectors therein.

3 Claims, 2 Drawing Sheets

CONNECTOR RETAINING DEVICE

CROSS-REFERENCE TO RELATED APPLICATION

This application is related to two commonly-assigned co-pending applications both entitled "CONNECTOR RETAINING DEVICE" Ser. Nos. 13/172,866 and 13/172,883. The disclosure of the above-identified applications are incorporated herein by references.

BACKGROUND

1. Technical Field

The present disclosure relates to connector devices, and particularly, relates to a connector device for connecting two unsupported cables to each other.

2. Description of Related Art

In the cable connecting field, a connector device typically includes a first connector and a second connector coupled together for interconnecting the cables.

The first connector and the second connector are connected to each other just by inserting the first connector into the second connector, however the connection has no other support. The first connector and the second connector may be pulled apart by main force, or by unexpected collisions with other objects.

What is needed therefore is a connector device addressing the limitations described.

BRIEF DESCRIPTION OF THE DRAWINGS

The components of the drawings are not necessarily drawn to scale, the emphasis instead being placed upon clearly illustrating the principles of the embodiments of the connector device. Moreover, in the drawings, like reference numerals designate corresponding parts throughout several views.

DETAILED DESCRIPTION

Figure 1:
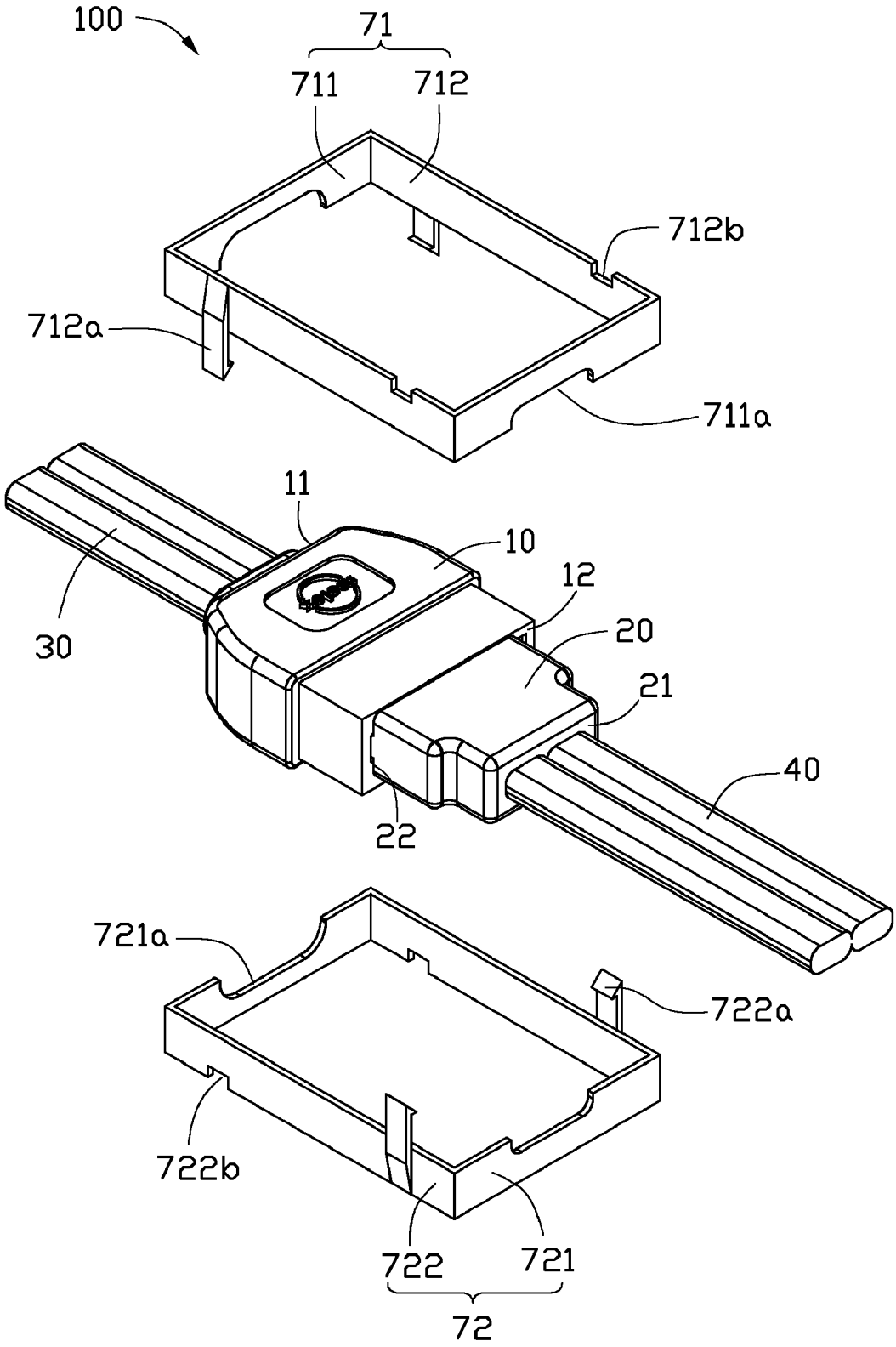
FIG. 1 is an exploded view of a connector device, according to an exemplary embodiment of the present disclosure.
Figure 2:
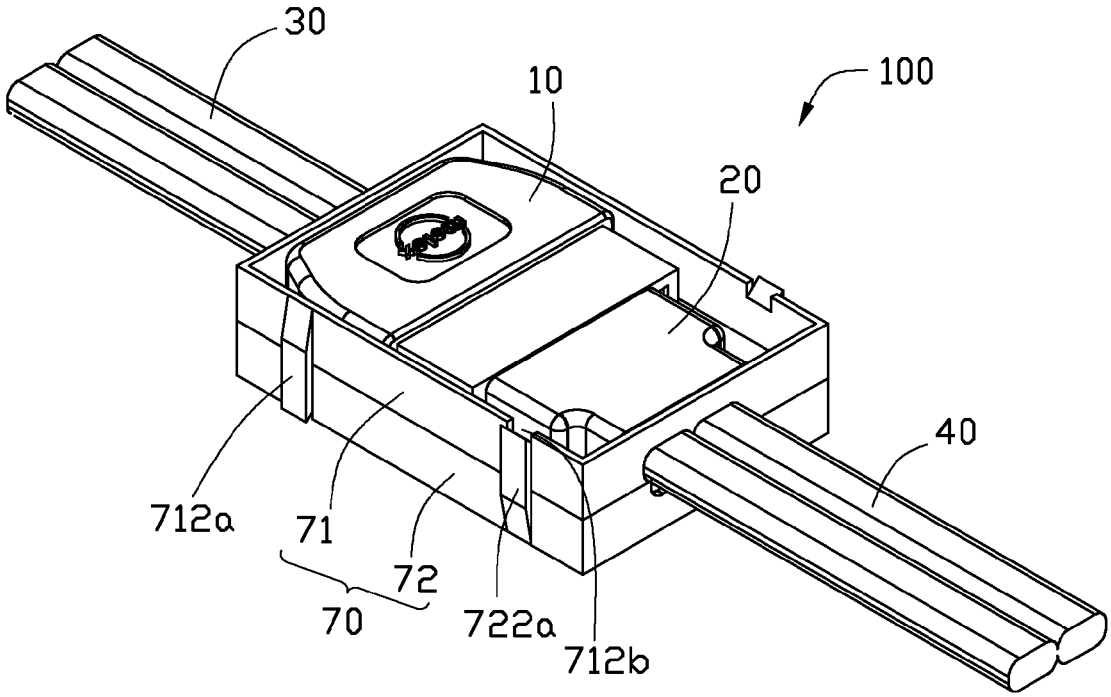
FIG. 2 is an assembled view of the connector device of FIG. 1.

Referring to the FIGS. 1-2, a connector device 100, according to an exemplary embodiment, is shown. The connector device 100 can be applied to electrical connectors or to optical connectors. The connector device 100 includes a first connector 10, a second connector 20, a first cable 30, a second cable 40 and a security member 70.

The first connector 10 includes a first connecting end 11 and a first insertion end 12 opposite to the first connecting end 11. The second connector 20 includes a second connecting end 21 and a second insertion end 22 opposite to the second connecting end 21.

The first cable 30 is connected to the first connecting end 11 of the first connector 10. The second cable 40 is connected to the second connecting end 21 of the second connector 20. Thus the first connector 10 and the first cable 30 form as a first connector cord (not labeled), and the second connector 20 and the second cable 40 form as a second connector cord (not labeled). The first cable 30 and the second cable 40 can be power cables or data cables. In this embodiment, the first cable 30 and the second cable 40 are Serial Advance Technology Attachment (SATA) cables, and the first connector 10 and the second connector 20 are SATA connectors.

The securing member 70 includes a upper frame 71 and a lower frame 72 in cooperation with the upper frame 71. The upper frame 71 and the lower frame 72 are substantially rectangular and substantially identical.

The upper frame 71 includes two substantially parallel end members 711 and two substantially parallel side members 712 connected to the end members 711. The end members 711 and the side members 712 are substantially perpendicular to each other. The end members 711 each define a recess 711*a* in a lower edge thereof. The side members 712 each include a hook 712*a* extending downwardly beyond a lower edge thereof, and the side members 712 each defines an cutout 712*b* in an upper edge thereof.

The lower frame 72 is identical to the upper frame 71. The lower frame 72 includes two end members 721 and two side members 722. The end members 721 each define a recess 721*a* in an upper edge thereof. The side members 722 includes an hook 722*a* extending upwardly beyond an upper edge thereof, and the side member 722 each define an cutout 722*b* in an lower edge thereof.

In assembly, the first connector 10 and the second connector are coupled for interconnecting the first cable 30 and the second cable 40. The upper frame 71 and the lower frame 72 cover the connected first connector 10 and the second connector 20 from two opposite directions. The hooks 712*a* of the upper frame 71 are respectively engaged into the cutouts 722*b* of the lower frame 72, and the hooks 722*a* of the lower frame 72 are respectively engaged into the cutouts 712*b* of the first engagement frame 71. The cotouts 711*a* of the upper frame 71 are respectively communicated with the cotouts 721*a* of the lower frame 72. Each recess 711*a* of the upper frame 71 and a corresponding recess 721*a* of the lower frame 72 meet together to form a through hole 73. The first cable 30 and the second cable 40 each pass through a corresponding through hole 73. Therefore, the upper frame 71 and the lower frame 72 sandwich the combined first connector 10 and the second connector 20 therebetween. The end members 711 of the upper frame 71 respectively butt against the first connecting end 11 of the first connector 10 and the second connecting end 21 of the second connector 20, and the end members 721 of the upper frame 72 respectively butt against the first connecting end 11 of the first connector 10 and the second connecting end 21 of the second connector 20. Therefore, the upper frame 71 and the lower frame 72 can maintain the completeness of the connection between the first connector 10 and the second connector 20 as well as the strength.

The present embodiments and the advantages will be understood from the foregoing description, and various changes may be made thereto without departing from the spirit and scope of the disclosure or sacrificing all of its material advantages, the examples hereinbefore described merely being preferred or exemplary embodiments of the disclosure.

What is claimed is:

1. A connector retaining device for retaining interconnection between two connector cords, each connector cord including a cable and a connector, the connectors are mechanically coupled to each other, the connector retaining device comprising:

an upper frame comprising two parallel side members and two parallel end members connected between opposite ends of the side members, each side member including a cutout defined in an upper edge thereof and a hook extending downwardly beyond a lower edge thereof, each end member defining a recess in a lower edge thereof; and a lower frame comprising two parallel side members and two parallel end members connected between opposite ends of the side members, each side member including a cutout defined in a lower edge thereof and a hook extending upward beyond an upper edge thereof, each end member defining a recess in an upper edge thereof;

wherein the upper frame is attachable to the lower frame in a manner such that the hooks of the upper frame engage in the cutouts of the lower frame, the hooks of the lower frame engage in the cutouts of the upper frame, the recesses of the upper frame and the lower frame cooperatively form two through holes for extension the cables therethrough, the combined upper frame and the lower frame configured for sandwiching the combined connectors therebetween and surrounding the combined connectors therein.

2. The connector device of claim 1, wherein the side members of the upper frame are perpendicular to the end members of the upper frame, and the side members of the lower frame are perpendicular to the end members of the lower frame.

3. A connector retaining device comprising:

two connector cords, each connector cord including a cable and a connector, the connectors being mechanically coupled to each other;

an upper frame comprising two parallel side members and two parallel end members connected between opposite ends of the side members, each side member including a cutout defined in an upper edge thereof and a hook extending downwardly beyond a lower edge thereof, each end member defining a recess in a lower edge thereof; and a lower frame comprising two parallel side members and two parallel end members connected between opposite ends of the side members, each side member including a cutout defined in a lower edge thereof and a hook extending upward beyond an upper edge thereof, each end member defining a recess in an upper edge thereof;

wherein the upper frame is attachable to the lower frame in a manner such that the hooks of the upper frame engage in the cutouts of the lower frame, the hooks of the lower frame engage in the cutouts of the upper frame, the recesses of the upper frame and the lower frame cooperatively form two through holes for extension the cables therethrough, the combined upper frame and the lower frame configured for sandwiching the combined connectors therebetween and surrounding the combined connectors therein.

* * * * *

UNITED STATES PATENT AND TRADEMARK OFFICE

CERTIFICATE OF CORRECTION

PATENT NO. : 8,215,978 B1
APPLICATION NO. : 13/172877
DATED : July 10, 2012
INVENTOR(S) : Zheng-Heng Sun et al.

It is certified that error appears in the above-identified patent and that said Letters Patent is hereby corrected as shown below:

On the Title Page:
Please replace Item (75) regarding "Inventors" on the front page of the Patent with the following:

(75) Inventors: Zheng-Heng Sun, New Taipei (TW); Li-Ren FU, Shenzhen (CN); Jun-Hui Wang, Shenzhen (CN); Ai-Ling He, Shenzhen (CN).

Signed and Sealed this
Second Day of October, 2012

David J. Kappos

David J. Kappos
*Director of the United States Patent and Trademark Office*